US010372076B2

(12) United States Patent
Takahashi

(10) Patent No.: US 10,372,076 B2
(45) Date of Patent: Aug. 6, 2019

(54) SHEET PROCESSING APPARATUS

(71) Applicant: CANON FINETECH NISCA INC., Misato-shi, Saitama (JP)

(72) Inventor: Tatsuya Takahashi, Kai (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/951,307

(22) Filed: Apr. 12, 2018

(65) Prior Publication Data

US 2018/0299818 A1 Oct. 18, 2018

(30) Foreign Application Priority Data

Apr. 17, 2017 (JP) ..... 2017-081423
Mar. 13, 2018 (JP) ..... 2018-045827

(51) Int. Cl.

| | |
|---|---|
| ***B65H 37/04*** | (2006.01) |
| ***G03G 15/00*** | (2006.01) |
| ***B65H 43/06*** | (2006.01) |
| ***B42C 1/12*** | (2006.01) |
| ***B31F 5/02*** | (2006.01) |
| ***B42B 4/00*** | (2006.01) |
| ***B42B 5/00*** | (2006.01) |

(52) U.S. Cl.

CPC ..... *G03G 15/6544* (2013.01); *B31F 5/02* (2013.01); *B42B 4/00* (2013.01); *B42B 5/00* (2013.01); *B42C 1/12* (2013.01); *B42C 1/125* (2013.01); *B65H 37/04* (2013.01); *B65H 43/06* (2013.01); *B31F 2201/07* (2013.01); *B31F 2201/0758* (2013.01); *B31F 2201/0779* (2013.01); *B65H 2301/43828* (2013.01); *B65H 2301/51616* (2013.01); *B65H 2408/1222* (2013.01); *B65H 2801/27* (2013.01); *G03G 2215/00827* (2013.01)

(58) Field of Classification Search

CPC ..... G03G 15/6544; G03G 2215/00827; G03G 2215/00852; B42C 1/125; B65H 43/00; B65H 37/04; B65H 2301/43828; B65H 2301/51616; B42F 3/00; B31F 1/07; B31F 5/02; B31F 2201/07; B31F 2201/0758; B31F 2201/0779

USPC ..... 270/58.08, 58.09

See application file for complete search history.

(56) References Cited

U.S. PATENT DOCUMENTS 5,169,133 A * 12/1992 Iwata ..... B42B 4/00 270/58.11
5,599,009 A * 2/1997 Mandel ..... B42C 1/125 270/58.09

(Continued)

FOREIGN PATENT DOCUMENTS

JP 2010-274623 A 12/2010
JP 2015-089843 A 5/2015

(Continued)

*Primary Examiner* — Leslie A Nicholson, III
(74) *Attorney, Agent, or Firm* — Venable LLP

(57) ABSTRACT

There is provided a sheet post-processing apparatus capable of performing eco-stapling processing to prevent a decrease in binding force by the thickness of a sheet with a simple arrangement by changing a stapling count depending on the grammage and size of a sheet and the number of sheets in consideration of the change in binding force caused by the sheet size.

10 Claims, 11 Drawing Sheets

(56) References Cited

U.S. PATENT DOCUMENTS

2015/0350469 A1* 12/2015 Kanamoto ..... G03G 15/6544
358/1.15
2017/0217239 A1* 8/2017 Suzuki ..... B42C 1/12

FOREIGN PATENT DOCUMENTS

JP 2016-098094 A 5/2016
JP 2017136732 A * 8/2017 ..... B42C 1/12

* cited by examiner

BINDING OPERATION AT SAME POSITION

BINDING OPERATION WHEN STAPLING POSITIONS PARTIALLY OVERLAP

BINDING OPERATION WHEN CORNER BINDING POSITIONS PARTIALLY OVERLAP

SHEET PROCESSING APPARATUS

BACKGROUND OF THE INVENTION

Field of the Invention

The present invention relates to a sheet post-processing apparatus which performs staple free stapling (also to be referred to as staple free binding or eco-stapling) processing for binding sheets without using staples.

Description of the Related Art

In recent years, in a sheet post-processing apparatus which binds a sheet bundle by forming concave and convey portions in the sheet bundle by a pair of binding members, there is proposed a technique with a plurality of binding members having teeth of different shapes as the binding members for forming the concave and convex portions by clamping the sheet bundle. According to this technique, the concave and convex portions are formed in the sheet bundle by selectively using one of the plurality of binding member pairs in accordance with the sheet bundle (see Japanese Patent Laid-Open No. 2010-274623).

The above conventional techniques, however, have the following problems. In the technique described in Japanese Patent Laid-Open No. 2010-274623, the plurality of binding member pairs having the teeth of the different shapes are provided, and this technique cannot be implemented without adding a large space and a mechanism for exchanging binding members.

SUMMARY OF THE INVENTION

The present invention provides a sheet post-processing apparatus capable of performing staple free binding processing at a binding force corresponding to the attribute of a sheet or sheet bundle with a simple arrangement.

The sheet processing apparatus according to the present invention has the following arrangement.

According to an aspect of the present invention, there is provided a sheet processing apparatus comprising: a binding unit configured to perform binding processing for a sheet bundle without using a staple; an obtaining unit configured to obtain information about grammage values of sheets forming the sheet bundle; and a control unit configured to control the binding unit to allow a change in a binding count of the binding unit in accordance with information about the grammage values of outermost sheets of the sheet bundle, the information being obtained by the obtaining unit, if the obtaining unit obtains information indicating that the sheet bundle is made of sheets having a plurality of different grammage values.

According to the present invention, staple free binding processing can be performed at a binding force corresponding to the attribute of a sheet or sheet bundle with a simple arrangement.

Further features of the present invention will become apparent from the following description of exemplary embodiments (with reference to the attached drawings).

DESCRIPTION OF THE EMBODIMENTS

Preferred embodiments of the present invention will be described in detail with reference to the accompanying drawings.

First Embodiment

Figure 1:
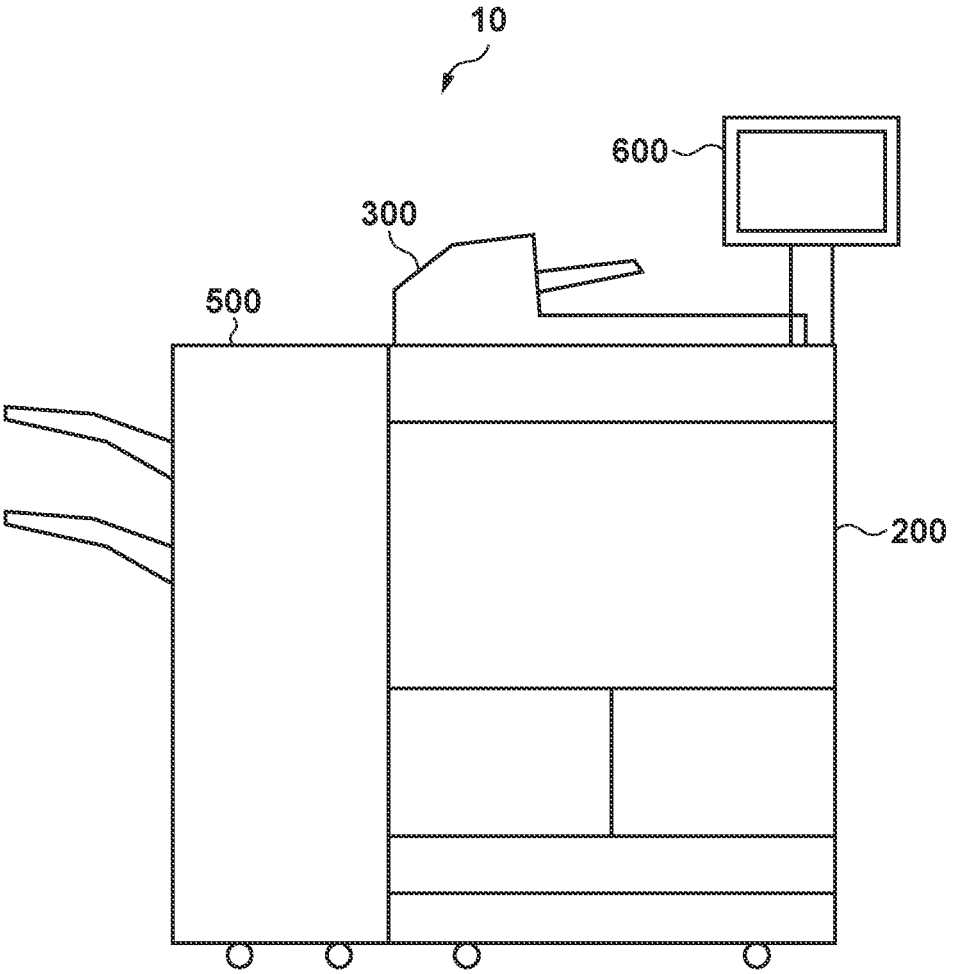
FIG. 1 is a view showing the overall arrangement example of an image forming system according to an embodiment.

FIG. 1 is a view showing the overall arrangement example of an image forming system according to an embodiment. An image forming system 10 includes an image forming apparatus 200 for forming an image on a sheet material (for example, paper sheet), and a post-processing apparatus 500 for performing post-processing on the image-formed sheet. The image forming apparatus 200 includes an original reading unit 300 for receiving an original and reads the received original. An operation unit 600 of the image forming system 10 accepts an operation input from a user to the image forming apparatus 200 and the post-processing apparatus 500.

<Arrangement of Image Forming Apparatus>

Figure 2:
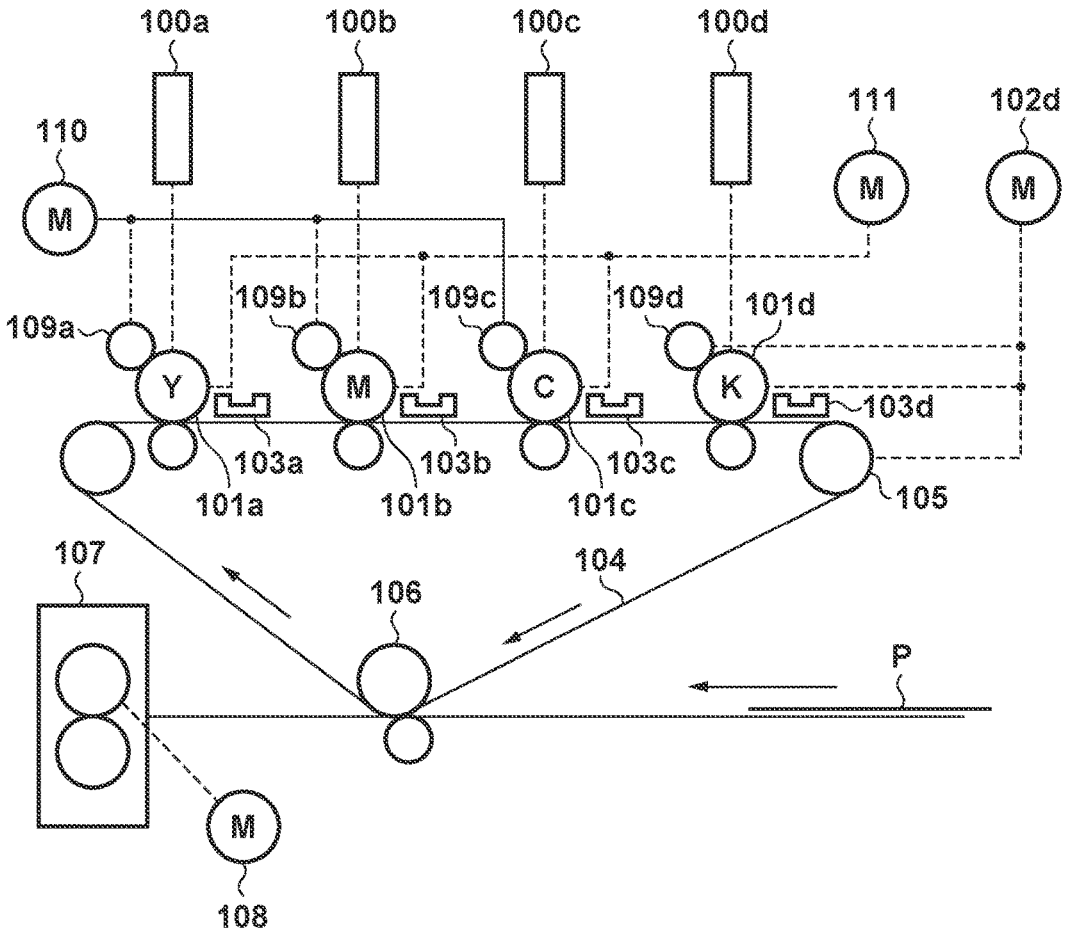
FIG. 2 is a view showing the schematic arrangement example of an image forming apparatus.

FIG. 2 is a view showing the schematic arrangement example of the image forming apparatus 200 of the image forming system 10. The image forming apparatus 200 of the image forming system 10 forms a color image using toners of four colors, that is, yellow (Y), magenta (M), cyan (C), and black (K). The image forming apparatus 200 includes laser scanners 100*a*, 100*b*, 100*c*, and 100*d*, photosensitive drums 101*a*, 101*b*, 101*c*, and 101*d*, a black photosensitive drum driving motor 102*d*, and phase difference detection sensors 103*a*, 103*b*, 103*c*, and 103*d*. In addition, the image forming apparatus 200 includes an intermediate transfer belt 104, an intermediate transfer roller 105, a transfer roller 106, a fixing unit (fixing mechanism) 107, and a fixing roller driving motor 108. The image forming apparatus 200 further includes developing units 109*a*, 109*b*, 109*c*, and 109*d*, a color developing driving motor 110, and a color photosensitive drum driving motor 111. Note that the photosensitive drum 101*a*, the phase difference detection sensor 103*a*, and the developing unit 109*a* are used for yellow, and the photosensitive drum 101*b*, the phase difference detection sensor 103*b*, and the developing unit 109*b* are used for magenta. In addition, the photosensitive drum 101*c*, the phase difference detection sensor 103*c*, and the developing unit 109*c* are used for cyan, and the photosensitive drum

101*d*, the phase difference detection sensor 103*d*, and the developing unit 109*d* are used for black.

The black photosensitive drum driving motor 102*d* drives the intermediate transfer roller 105 in addition to driving the photosensitive drum 101*d* and the developing unit 109*d*. Note that the intermediate transfer roller 105 is a roller for conveying the intermediate transfer belt 104. The fixing roller driving motor 108 drives the fixing roller of the fixing unit 107. The color developing driving motor 110 drives the developing units 109*a*, 109*b*, and 109*c*. The color photosensitive drum driving motor 111 drives the photosensitive drums 101*a*, 101*b*, and 101*c*.

An example of an image forming process in the image forming system 10 will be described below. The image forming apparatus 200 of the image forming system 10 starts receiving an original and reading it in the original reading unit 300 in response to acceptance of a print instruction from the user via the operation unit 600. The image signals of the read colors are sent to the laser scanners 100*a*, 100*b*, 100*c*, and 100*d*, respectively. When a print instruction is received together with image data from a host computer 211 via a communication controller 901 (to be described later), the image signals of the respective colors based on this image data are supplied to the laser scanners 100*a*, 100*b*, 100*c*, and 100*d*, respectively.

The laser scanners 100*a*, 100*b*, 100*c*, and 100*d* perform exposure of the corresponding photosensitive bodies in accordance with the image signals to form electrostatic latent images on the precharged photosensitive drums 101*a*, 101*b*, 101*c*, and 101*d*, respectively. The electrostatic latent images formed on the photosensitive drums 101*a*, 101*b*, 101*c*, and 101*d* are developed with toners by the corresponding developing units 109*a*, 109*b*, 109*c*, and 109*d*. The toner images of the respective colors formed on the surfaces of the photosensitive drums 101*a*, 101*b*, 101*c*, and 101*d* are transferred (primary transfer) to the intermediate transfer belt 104 so as to sequentially overlap the toner images. Note that the intermediate transfer belt 104 is conveyed clockwise when viewed from the front side in FIG. 2.

After that, the toner image transferred to the intermediate transfer belt 104 is further transferred (secondary transfer) to a paper sheet P fed in the direction of an arrow from the right side in FIG. 2 at the position of the transfer roller 106. After the transfer, the toner image is fixed on the paper sheet P by heat generated by the fixing unit 107. The paper sheet P on which the toner image is fixed is discharged outside (for example, the discharge tray) the image forming apparatus 200. The discharged paper sheet P is conveyed to the post-processing apparatus 500.

In the image forming system 10 of this embodiment, a warm-up operation for heating the fixing unit 107 in advance in a standby state in which a print instruction can be received is performed. This makes it possible to shorten the time required from the reception of the print instruction until the paper sheet P on which the toner image is fixed is discharged. The fixing unit 107 is arranged to be cooled by a cooling control unit 208 (not shown) arranged near the fixing unit 107. Note that the basic image forming operation described above is merely an example, and the present invention is not limited to the above arrangement.

[Post-Processing Apparatus]

Figure 3:
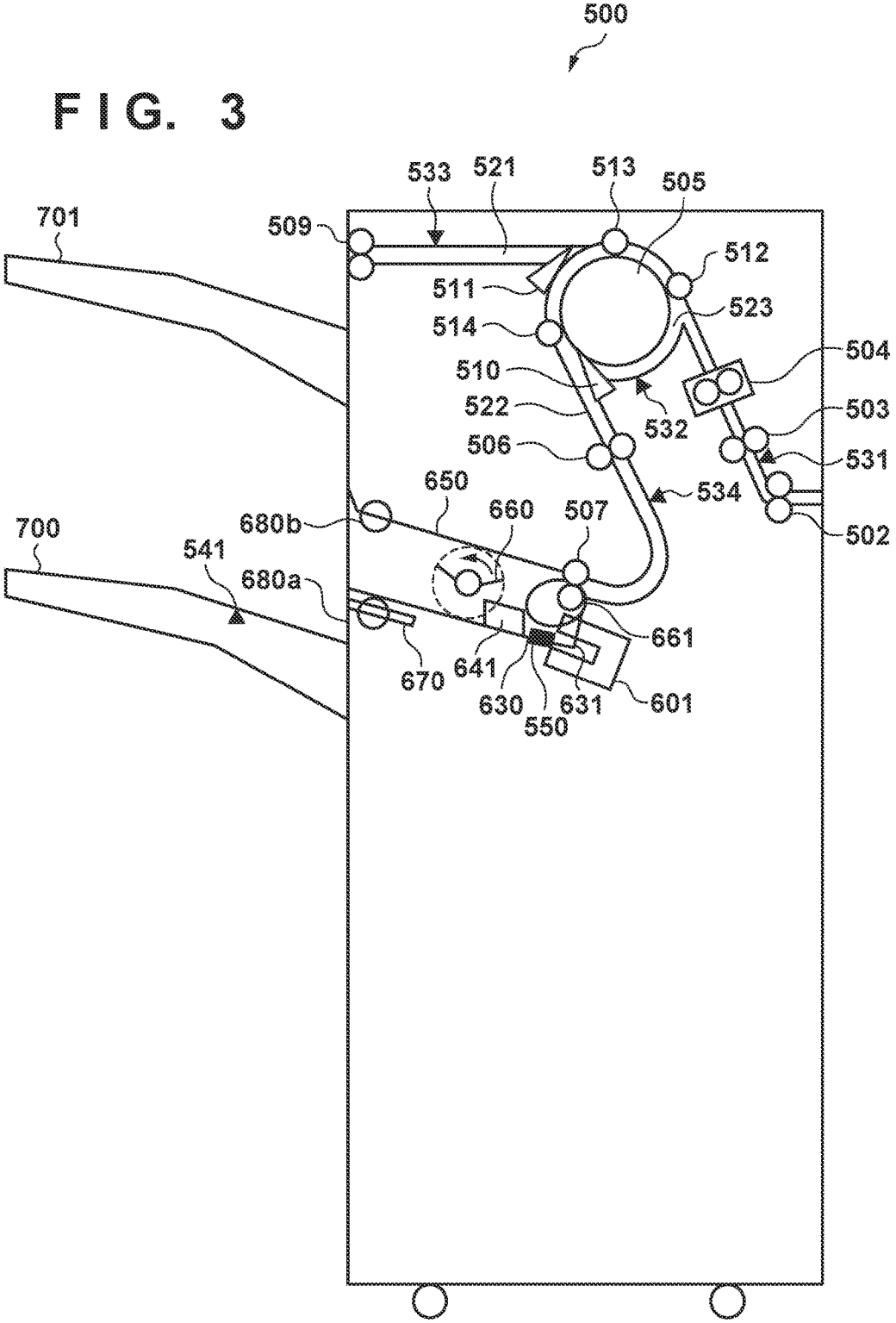
FIG. 3 is a view showing the schematic arrangement example of a post-processing apparatus 500.

FIG. 3 is a view showing the schematic arrangement example of the post-processing apparatus 500 connected to the image forming apparatus 200. The post-processing apparatus 500 of the image forming system 10 performs predetermined post-processing for the paper sheet P on which an image is formed.

The post-processing apparatus 500 includes an inlet roller pair 502, roller pairs 503, 504, 506, 507, and 509 which form a conveyance mechanism, a buffer roller 505, switching flappers 510 and 511, and press rollers 512, 513, and 514. The post-processing apparatus 500 further includes conveyance sensors 531, 532, 533, and 534, a paper presence/absence detection sensor 541, an eco-stapler 550, a stapler 601, a processing tray 630, stoppers 631, and aligning members 641. In addition, the post-processing apparatus 500 includes a swinging guide 650, a paddle 660, a knurled belt 661, a retractable tray 670, discharge rollers 680*a* and 680*b*, a stacking tray 700, and a sample tray 701. The eco-stapler is a mechanism for binding a sheet bundle without using a binding member such as a staple.

A non-sorting path 521, a sorting path 522, and a buffer path 523 which serve as the paths through which the paper sheet P passes during the conveyance process are formed in the post-processing apparatus 500.

The post-processing apparatus 500 sequentially receives the paper sheets P on which the toner images are fixed and which are discharged from the image forming apparatus 200 and performs processing (sort processing) for aligning the plurality of received paper sheets P to obtain one bundle. The post-processing apparatus 500 performs various sheet post-processing operations such as stapling processing for stapling the end portions of the paper sheets P as a copy having the bundled sheets, non-sorting processing for discharging the sheets without stapling processing.

The inlet roller pair 502 is rotated and driven to receive, to the post-processing apparatus 500, the paper sheets P discharged from the image forming apparatus 200. The paper sheets P received inside via the inlet roller pair 502 are conveyed to the buffer roller 505 via the roller pairs 503 and 504. The conveyance sensor 531 is arranged midway along the conveyance path between the inlet roller pair 502 and the roller pair 503. The respective conveyance sensors including the conveyance sensor 531 detect the passage of each paper sheet P.

The buffer roller 505 is a roller which is rotated in a predetermined rotation direction and stacks a predetermined number of paper sheets P sequentially conveyed during the rotation, and the paper sheets are wound around the outer surface of the buffer roller 505. The press rollers 512, 513, and 514 arranged to oppose the outer surface of the buffer roller 505 press the paper sheet P against the outer surface of the buffer roller 505. This makes it possible to wind the paper sheet P on the outer surface of the buffer roller 505. The wound paper sheet P is conveyed in the rotation direction of the buffer roller 505.

The switching flapper 511 is arranged midway along the conveyance path between the press roller 513 and the press roller 514. Similarly, the switching flapper 510 is arranged midway along the conveyance path between the press roller 514 and the roller pair 506.

The switching flapper 510 and the switching flapper 511 are operated such that their end portions come into contact with the outer surface of the buffer roller 505 or are separated from the outer surface. When the end portions of the switching flapper 510 and the switching flapper 511 are brought into contact with the outer surface of the buffer roller 505, the paper sheet P wound on the buffer roller 505 is separated from the outer surface. The paper sheet P separated from the buffer roller 505 by the switching flapper 510 is guided to the sorting path 522. That is, the sheet wound on the buffer roller 505 overlaps the succeeding sheet, and these sheets are guided as a sheet bundle to the sorting path 522. The sheet bundle is conveyed in a state in which the sheet wound on the buffer roller 505 is kept separated from the preceding sheet. Note that processing for conveying the sheets while the plurality of sheets overlap each other by using the buffer roller 505 is called buffer processing. The paper sheet P separated from the buffer roller 505 by the switching flapper 511 is guided to the non-sorting path 521. In a state in which the end portions of the switching flapper 510 and the switching flapper 511 are not brought into contact with the outer surface of the buffer roller 505, the paper sheet P wound on the buffer roller 505 is not separated and guided to the buffer path 523.

The paper sheet P guided to the non-sorting path 521 is discharged onto the sample tray 701 via the roller pair 509. The conveyance sensor 533 is arranged midway along the non-sorting path 521. The paper sheet P guided to the sorting path 522 is discharged onto the processing tray 630 via the roller pairs 506 and 507. The conveyance sensor 534 is arranged midway along the sorting path 522. The conveyance sensor 532 is arranged midway along the buffer path 523.

<Staple Free Stapling Processing>

Figure 4A:
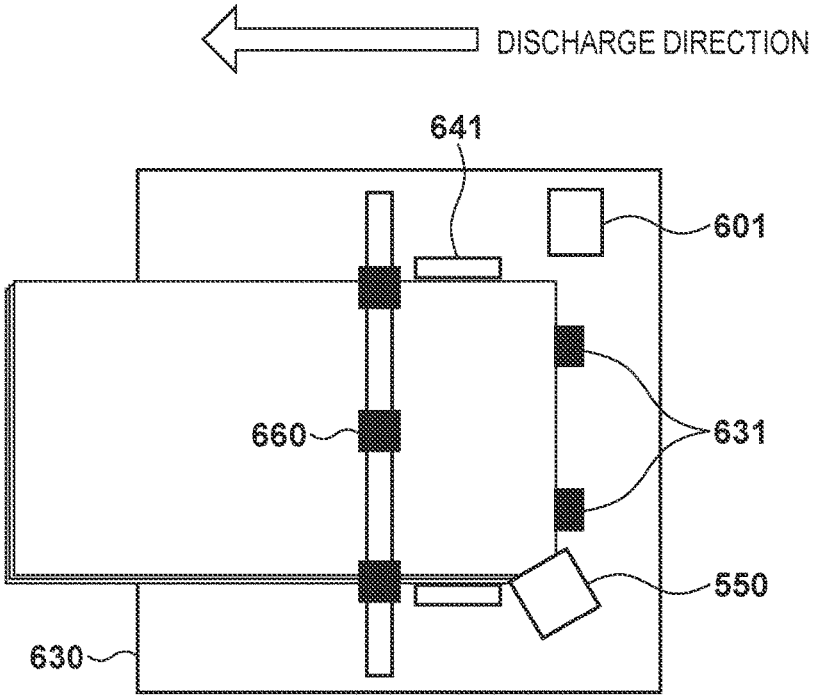
FIGS. 4A and 4B are views for explaining the states of a sheet bundle when performing eco-stapling processing.
Figure 4B:
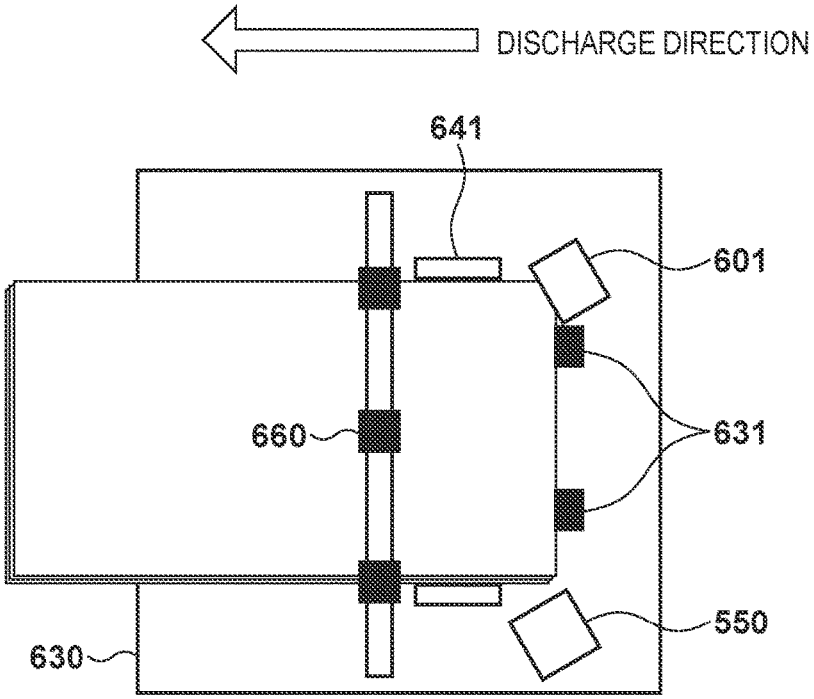

The paper sheet positions in stapling processing (also to be referred to as eco-stapling processing, staple free stapling processing or staple free binding processing) using the eco-stapler 550 will be described with reference to FIGS. 4A and 4B. FIGS. 4A and 4B are views for explaining a state of a sheet bundle (paper sheet bundle) when performing eco-stapling processing using the post-processing apparatus 500. Note that FIG. 4A shows an example of eco-stapling processing, and FIG. 4B shows an example of stapling processing using the staple stapler 601.

The paper sheets P stacked in a bundle on the processing tray 630 are returned in a direction opposite to the conveyance direction by the knurled belt 661 and the paddle 660 driven in synchronism with the roller pair 507 and abut against with the stoppers 631.

In the binding processing using the eco-stapler 550, the stoppers 631 are moved to the position shown in FIG. 4A via a stopper moving motor M15 (to be described later with reference to FIG. 6). The paper sheet bundle is returned to the position of the stoppers 631, and binding processing is then performed. In the eco-stapler 550, the sheet bundle is clamped and pressed by the opposing binding members at the sheet bundle binding position. For example, the concave and convex portions having inverted phases are formed on the opposing surfaces of the binding members brought into contact with the sheet bundle. The sheet bundle is bound by forming the concave and convex portions on the sheet bundle. The detailed arrangement will be described with reference to FIGS. 5A and 5B.

When performing stapling processing using the stapler 601, the stapler 601 is moved to the stapling position by a stapler moving motor M10 (to be described later with reference to FIG. 6), and the eco-stapler 550 is retracted by the same driving as the motor M10 to the position shown in FIG. 4B. After that, the sheet bundle is returned to the position of the stoppers 631, and then stapling processing is performed.

The aligning members 641 arranged on the front side (the lower side in each of FIGS. 4A and 4B) and on the rear side (the upper side in each of FIGS. 4A and 4B) on the processing tray 630 are movable along the direction perpendicular to the conveyance direction of the paper sheet P. The aligning members 641 press the side edges of the paper sheets P stacked on the processing tray 630 to perform alignment processing for aligning the side edges of the paper sheets P. The sheet bundle aligned at the position of FIGS. 4A and 4B is pressed and bonded at a predetermined binding portion by the eco-stapler 550 (to be described later) arranged on each of the front and rear sides, thereby performing the binding processing. After that, the bound sheet bundle is discharged on a stacking tray 590 by discharge rollers 680 including the discharge rollers 680*a* and 680*b*. Note that aligning processing can be performed every time each paper sheet of the sheet bundle subjected to the stapling or binding processing is stacked on the processing tray 630.

Referring back to FIG. 3, the discharge roller 680*b* is supported by the swinging guide 650, and the swinging guide 650 swings so that the discharge roller 680*b* is brought into contact with the sheet bundle stacked on the processing tray 630. While the discharge roller 680*b* is kept in contact with the sheet bundle, the discharge roller 680*b* is rotated together with the discharge roller 680*a* to discharge the sheet bundle on the processing tray 630 to the stacking tray 700.

The retractable tray 670 projects upward when the paper sheet P is stacked on the processing tray 630. This makes it possible to prevent drooping or a return error of the paper sheet P discharged from the roller pair 507 and improve the aligning property of the paper sheets P on the processing tray 630.

The stacking tray 700 is arranged to be vertically movable by a driving force of a tray vertical movement motor M12 (to be described later). A paper surface detection sensor 540 can detect the tray surface of the stacking tray 700 on which no paper sheets P are stacked or the uppermost surface of the paper sheets P stacked on this tray. The stacking tray 700 is controlled such that the tray vertical movement motor M12 is driven in accordance with the detection result of the paper surface detection sensor 540 and the uppermost surface of the paper sheets P stacked on the tray is maintained at a predetermined position. The paper presence/absence detection sensor 541 is arranged at the stacking tray 700 to detect the presence/absence of the sheets P on the stacking tray 700. Note that the sample tray 701 is not vertically movable unlike the stacking tray 700 and is fixed at a position shown in FIG. 3.

[Stapler]

The stapler 601 is driven by a stapler motor M9 (to be described later with reference to FIG. 6). The stapler 601 is arranged to allow stapling at the stapling position of the paper sheet trailing end of the sheet bundle, in the paper sheet conveyance direction, stacked on the processing tray 630.

The stapler 601 is arranged to be movable in the direction perpendicular to the conveyance direction of the paper sheet P along the periphery of the processing tray 630. For example, when the user designates a stapling position, the stapler 601 is controlled to move to the position in advance before the paper sheet reaches this position. Note that the stapler 601 is generally known well, and a detailed description of the arrangement will be omitted.

[Eco-Stapler]

Figure 5A:
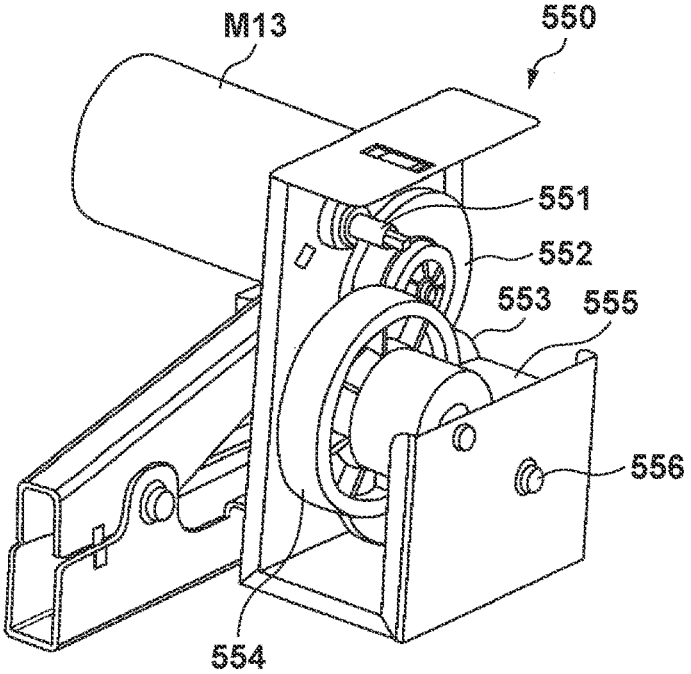
FIGS. 5A and 5B are views showing an example of the arrangement of an eco-stapler.
Figure 5B:
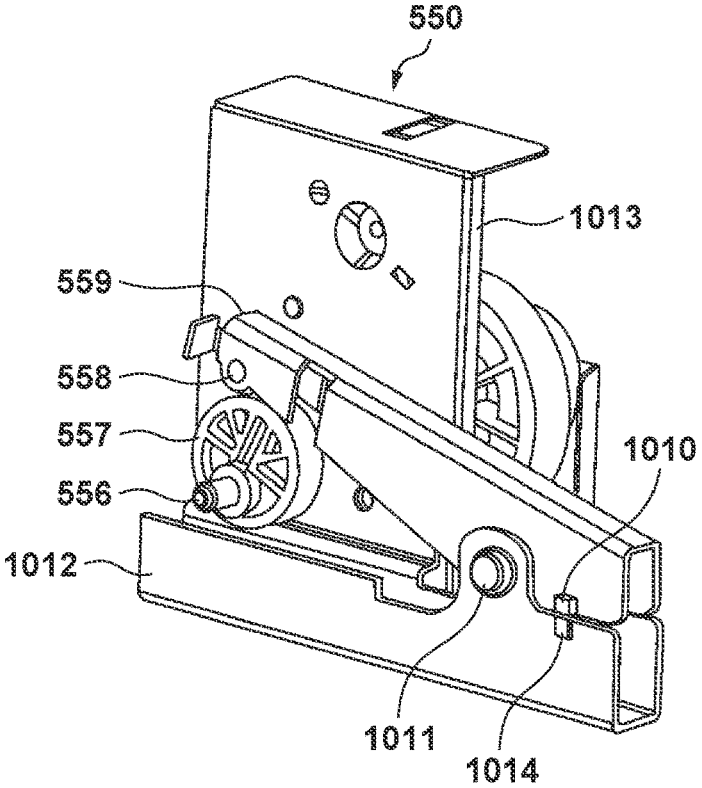

FIGS. 5A and 5B are views showing an example of the arrangement of an eco-stapler 550. FIG. 5A is a view when the eco-stapler 550 is viewed from one direction, and FIG. 5B is a view when the eco-stapler 550 is viewed from the other direction. Note that FIG. 5B shows an arrangement except an eco-stapler motor M shown in FIG. 5A.

The eco-stapler 550 includes the eco-stapler motor M, gears 551 and 555, stepped gears 552, 553, and 554, and a rotating shaft 556, as shown in FIG. 5A. In addition, as shown in FIG. 5B, the eco-stapler 550 further includes a cam 557, a roller 558, an upper arm 559, an upper tooth 1010, a shaft 1011, a lower arm 1012, a frame 1013, and a lower tooth 1014. Each of the upper tooth 1010 and the lower tooth 1014 has concave and convex portions (not shown). When they mesh with each other, the convex portion is fitted into the corresponding concave portion.

The rotation force (driving force) of the eco-stapler motor M13 is transmitted to the gear 555 via the gear 551 and the stepped gears 552, 553, and 554. The gear 555 is mounted on the rotating shaft 556 and rotates together with the rotating shaft 556.

The cam 557 is mounted on the rotating shaft 556 which receives the rotation force by the eco-stapler motor M13, as shown in FIG. 5B. The rotation force transmitted to the cam 557 operates the upper arm 559 via the roller 558. The upper tooth 1010 is mounted on the upper arm 559 and swings about the shaft 1011. The lower arm 1012 is fixed to the frame 1013. The lower tooth 1014 is mounted on the lower arm 1012. When the upper arm 559 swings, the concave and convex portions of the upper tooth 1010 and the lower tooth 1014 are fitted to each other to apply a force. The stapling portion of the sheet bundle is pressed at the fitting position of the upper tooth 1010 and the lower tooth 1014. The pressed sheet bundle is stretched to expose the fibers on the surface, and a pressure is further applied to entangle the fibers of the paper sheets P, thereby binding the paper sheets. As described above, the paper sheet bundle can be bound without using a staple.

The eco-stapler 550 is arranged to be movable in the direction perpendicular to the conveyance direction of the paper sheet P along the periphery of the processing tray 630. For example, when the user designates a binding position, the eco-stapler 550 is controlled to move to the position in advance before the paper sheet reaches this position.

Note that a sheet bundle is stapled by the stapler 601 using a metal staple. The number of paper sheets to be stapled is determined in accordance with the specifications of staples. In this embodiment, a sheet bundle having a maximum of 100 paper sheets can be stapled. In the eco-stapler 550, the paper sheets are meshed by the concave and convex portions of the upper tooth and the lower tooth to bind the paper sheets by bonding the fibers of the paper sheets. For this reason, if the shapes of the upper tooth and the lower tooth are determined in consideration of tear of the sheets, the eco-stapler 550 can bind, for example, a maximum of about five paper sheets, which is smaller than the number of sheets to be stapled by the stapler 601.

<Arrangement Example of Image Forming Apparatus and Post-Processing Apparatus>

Figure 6:
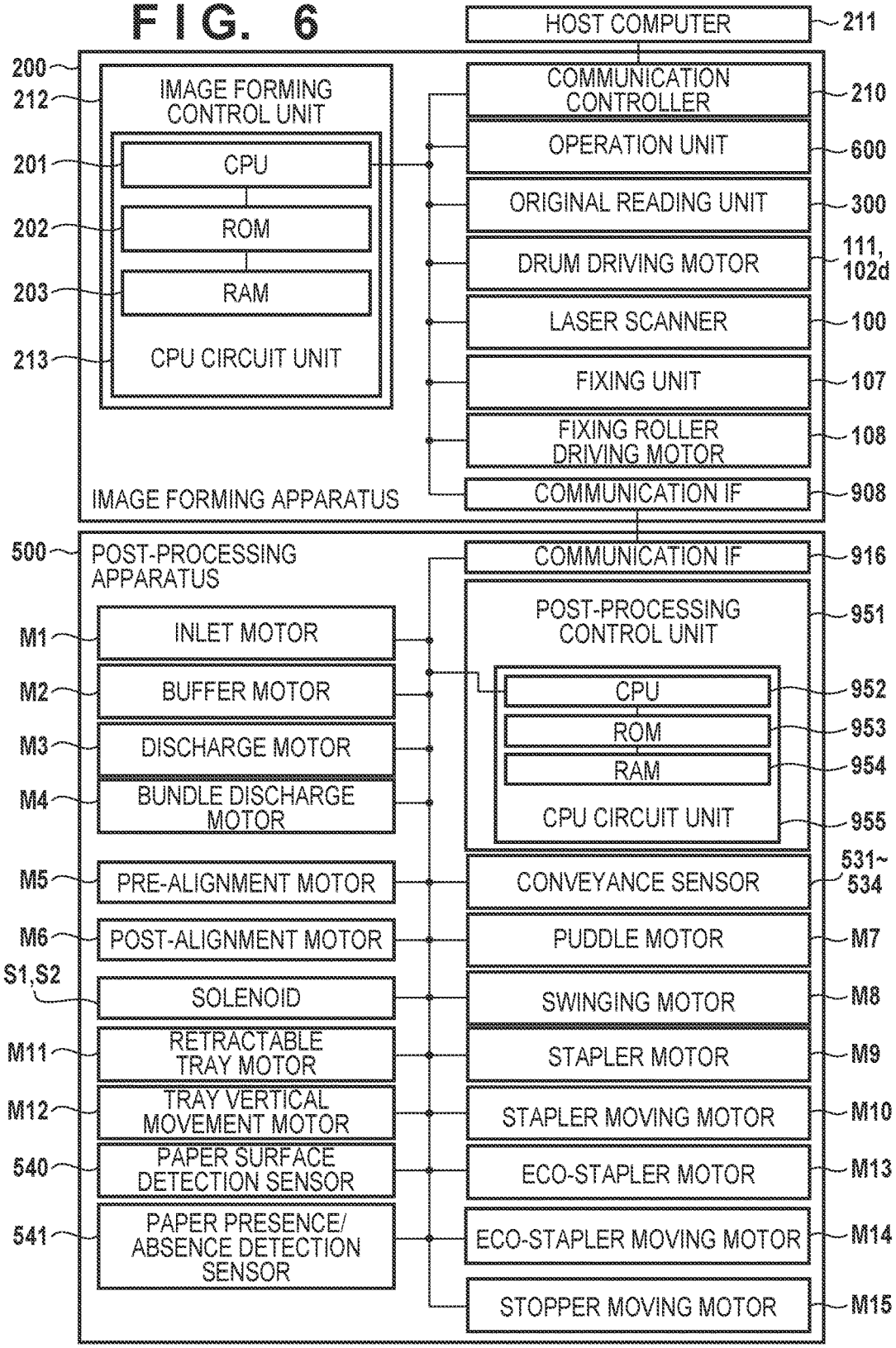
FIG. 6 is a block diagram showing the functional arrangement example of the image forming apparatus and the post-processing apparatus.

FIG. 6 is a block diagram showing the functional arrangement example of the image forming apparatus 200 and the post-processing apparatus 500 of the image forming system 10. An image forming control unit 212 shown in FIG. 6 includes a CPU circuit unit 213. The CPU circuit unit 213 includes a CPU 201, a ROM 202, a RAM 203, and a storage unit 204. The image forming control unit 212 is a kind of computer for controlling the respective units of the image forming apparatus 200 by causing the CPU 201 to execute predetermined control programs recorded in the ROM 202.

The image forming apparatus 200 receives an image forming instruction from the operation unit 600 or a host computer 211 via a communication controller 210. The CPU circuit unit 213 converts the received image forming instruction into job information data. Various kinds of programs stored in the ROM 202 are executed by the instructions from the image forming control unit 212 based on the job information.

The image forming control unit 212 controls the color photosensitive drum driving motor 111, the black photosensitive drum driving motor 102*d*, the laser scanner 100, the fixing roller driving motor 108, the fixing unit 107, and the like of the image forming apparatus 200 to form an image. In addition, the image forming control unit 212 outputs a job accompanying execution of post-processing to the post-processing apparatus 500 via a communication IF (Inter-Face) 908. The post-processing apparatus 500 obtains the job accompanying the post-processing from the image forming control unit 212 via a communication IF 916. Note that the image forming control unit 212 can be arranged to control the respective functional arrangements of the post-processing apparatus 500.

A post-processing control unit 951 shown in FIG. 6 is arranged to include a CPU circuit unit 955. The CPU circuit unit 955 is arranged to include a CPU 952, a ROM 953, and a RAM 954. The post-processing control unit 951 is a kind of computer for controlling the respective units of the post-processing apparatus 500 by causing the CPU 952 to execute predetermined control programs recorded in the ROM 953.

An inlet motor M1 of the post-processing apparatus 500 drives the inlet roller pair 502, the roller pair 503, and the like. A buffer motor M2 drives the buffer roller 505. A discharge motor M3 drives the roller pairs 506 and 507, and the like. A solenoid S1 drives the switching flapper 511. A solenoid S2 drives the switching flapper 510. The conveyance sensors 531 to 534 detect the passage of the paper sheet P in the conveyance paths in which the respective sensors are arranged.

A bundle discharge motor M4 drives the discharge roller 680. A pre-alignment motor M5 and a post-alignment motor M6 drive the corresponding aligning members 641. A puddle motor M7 drives the paddle 660. A swinging motor M8 drives the swinging guide 650. The stapler motor M9 supplies a driving force to operate the stapler 601. The stapler moving motor M10 supplies a driving force to move the stapler 601 to a predetermined processing position. A retractable tray motor M11 drives the retractable tray 670. The tray vertical movement motor M12 vertically moves the stacking tray 700 by its driving force. The eco-stapler motor M13 rotates the rotating shaft 556 in the forward or backward direction to supply a driving force for operating the eco-stapler 550. An eco-stapler moving motor M14 supplies a driving force to move the eco-stapler 550 to a predetermined processing position. That is, the eco-stapler moving motor M14 functions as a stapling position changing unit. The stopper moving motor M15 supplies a driving force to move the stoppers 631.

The paper surface detection sensor 540 detects the uppermost surface of the paper sheets P stacked on the stacking tray 700. The paper presence/absence detection sensor 541 detects the presence/absence of the paper sheets P on the stacking tray 700. Note that the post-processing apparatus 500 can receive a post-processing instruction from the operation unit 600 or the host computer 211.

[Binding Strength Increase Control]

Figure 7:
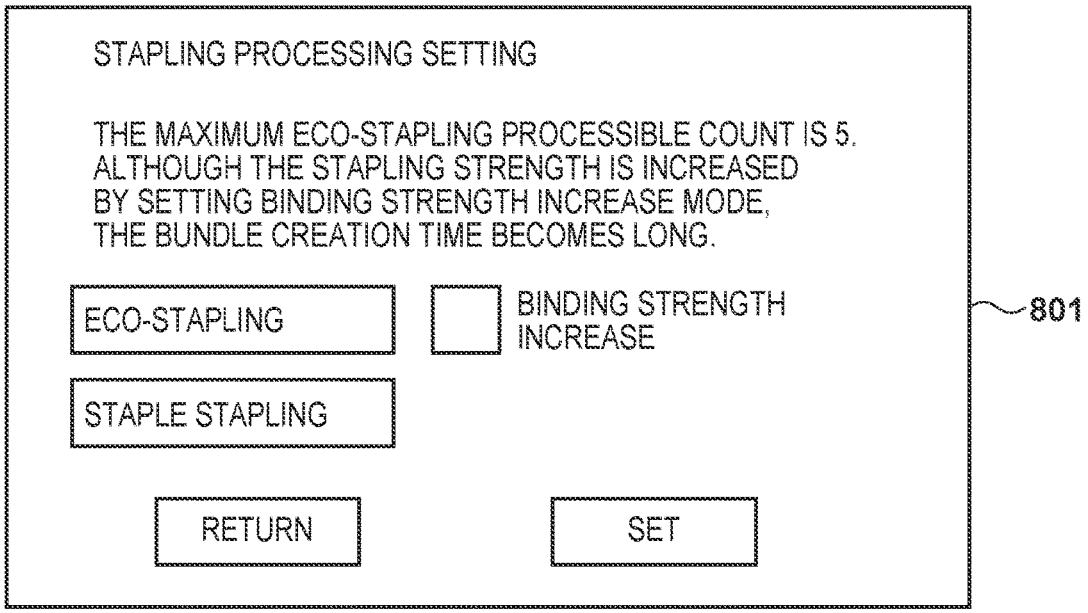
FIG. 7 is a view showing a screen example displayed on the display screen of an operation unit.

FIG. 7 is a view showing a screen example displayed on the display screen of the operation unit 600. FIG. 7 shows the screen example for selecting the stapler or eco-stapler. FIG. 7 shows an example of a binding strength increase setting screen (to be described later). The binding strength increase indicates an increase in binding force between the sheets to be described later.

The user instructs on a screen 801 shown in FIG. 7 whether binding processing is performed using the stapler or eco-stapler. If the user selects the binding processing using the eco-stapler, he can further select to shift to the control (binding strength increase control) for increasing the binding strength of eco-stapling. A set binding processing method is stored in, for example, the RAM 203 and is referred to for the binding processing.

The user can set the eco-stapling processing for a sheet bundle as one copy via the screen 801. The binding strength increase control can also be set in accordance with the sheet information. For example, the binding strength increase control is control for increasing the eco-stapling strength by performing eco-stapling processing for a sheet bundle of one copy in accordance with the sheet information at binding positions partially overlapping each other a plurality of times. If the binding strength increase control is not designated, for example, one eco-stapling processing is performed for a sheet bundle of one copy. The sheet information includes, for example, information of grammage, a sheet size, the number of sheets forming a sheet bundle, a paper type, and the like. In the binding strength increase control, the binding position of a second or subsequent time may be changed in accordance with, for example, sheet information. The binding strength increase control will now be described in detail below.

Figure 8A:
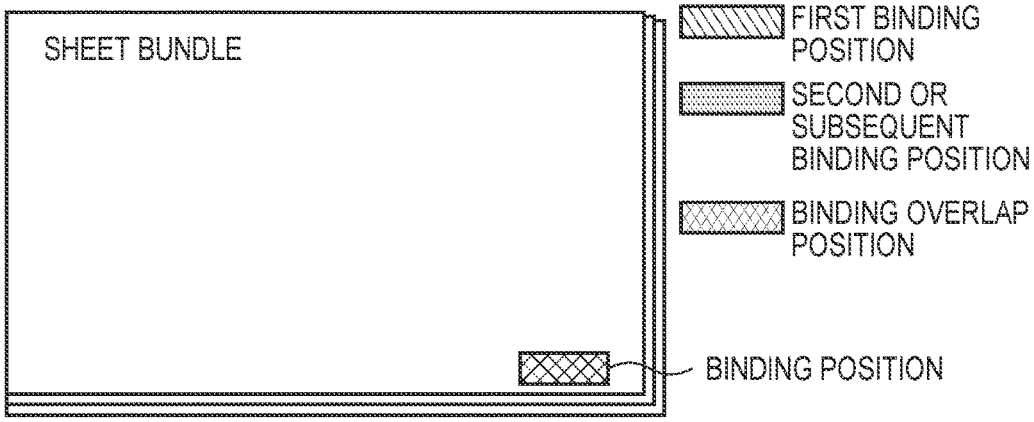
FIGS. 8A, 8B, and 8C are views for explaining binding processing in binding strength increase control.
Figure 8B:
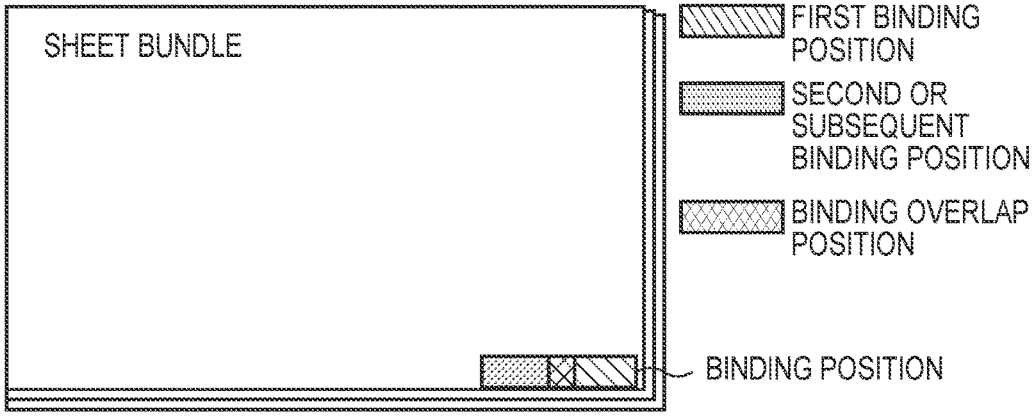
Figure 8C:
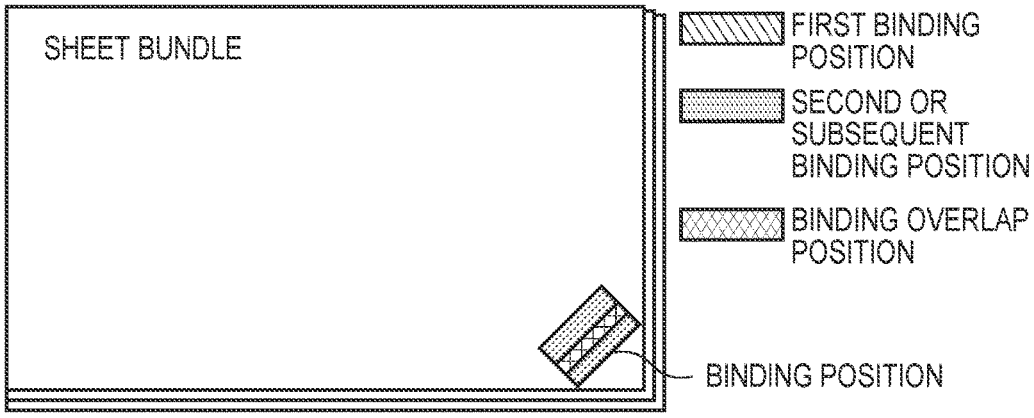

FIGS. 8A to 8C are views for explaining binding processing in binding strength increase control. The binding strength increase control in a case of eco-stapling for a sheet bundle will be described below.

For example, in stapling using the stapler 601, stapling processing is performed at one stapling position or a plurality of stapling operations so as not to overlap the stapling positions. Normally, even if the eco-stapler 550 is used, binding processing is performed at a plurality of binding positions so as not to overlap the binding positions. This binding processing will be referred to as a normal mode thereinafter.

As compared with the binding processing in the normal mode, the binding processing in binding strength increase control is performed within a range in which the binding regions overlap each other, as shown in FIGS. 8A to 8C. More specifically, the binding processing is performed at a higher binding strength than the binding strength in the normal mode. For example, if all or some of the sheets of a sheet bundle are thick paper sheets, after the binding processing is performed once, the binding operation is performed again while the sheet bundle is fixed by the aligning members 641 and the paper sheet trailing end stoppers 631. That is, the binding processing is performed again at the portion stapled by the upper tooth 1010 for the first time such that at least part of the binding position of the first time overlaps the binding operation for the second time. In this case, eco-stapling processing is performed a plurality of times in accordance with the grammage of the sheets forming one copy. The binding processing is performed at the same binding position a plurality of times to entangle the sheet fibers which are not entangled in the immediately preceding binding processing, thereby increasing the binding force.

FIG. 8A shows a case in which binding processing is performed at the same binding position a plurality of times so as not to shift the upper tooth 1010 even in the second or subsequent binding. A binding processing count is not limited to two, and can be three or more. Note that when binding processing is performed at the same position a plurality of times for thin paper sheets, the sheet fibers are damaged and torn, thereby decreasing the binding force. For this reason, as for thin paper sheets, the stapling operation in which the binding positions partially overlap is performed, thereby increasing the binding force, as shown in FIG. 8B. A thin paper sheet or thick paper sheet can be determined such that if the grammage of the sheet is equal to or more than a predetermined value, the sheet is a thick paper sheet; otherwise, the sheet is a thin paper sheet. In addition to the cases of FIGS. 8A and 8B, the above control can be applied to bookbinding having two binding positions or corner binding having one binding corner position shown in FIG. 8C. Although the binding processing is performed a plurality of times such that the binding positions partially overlap in FIG. 8C, the binding processing may be performed a plurality of times at a portion with sufficiently high stiffness, that is, a thick paper sheet portion so that the binding positions entirely overlap. In FIG. 8C, the binding position is moved obliquely with respect to the conveyance direction of the sheet bundle. However, the binding position may be moved to only one of the conveyance direction of the sheet bundle and a direction perpendicular to the conveyance direction. As a method of changing the binding position, instead of the method of relatively moving the eco-stapler 550 with reference to the sheet bundle, there may be employed a method of relatively moving the sheet bundle using a moving unit (or position changing unit) (not shown).

<Eco-Stapling Control Sequence>

Figure 9:
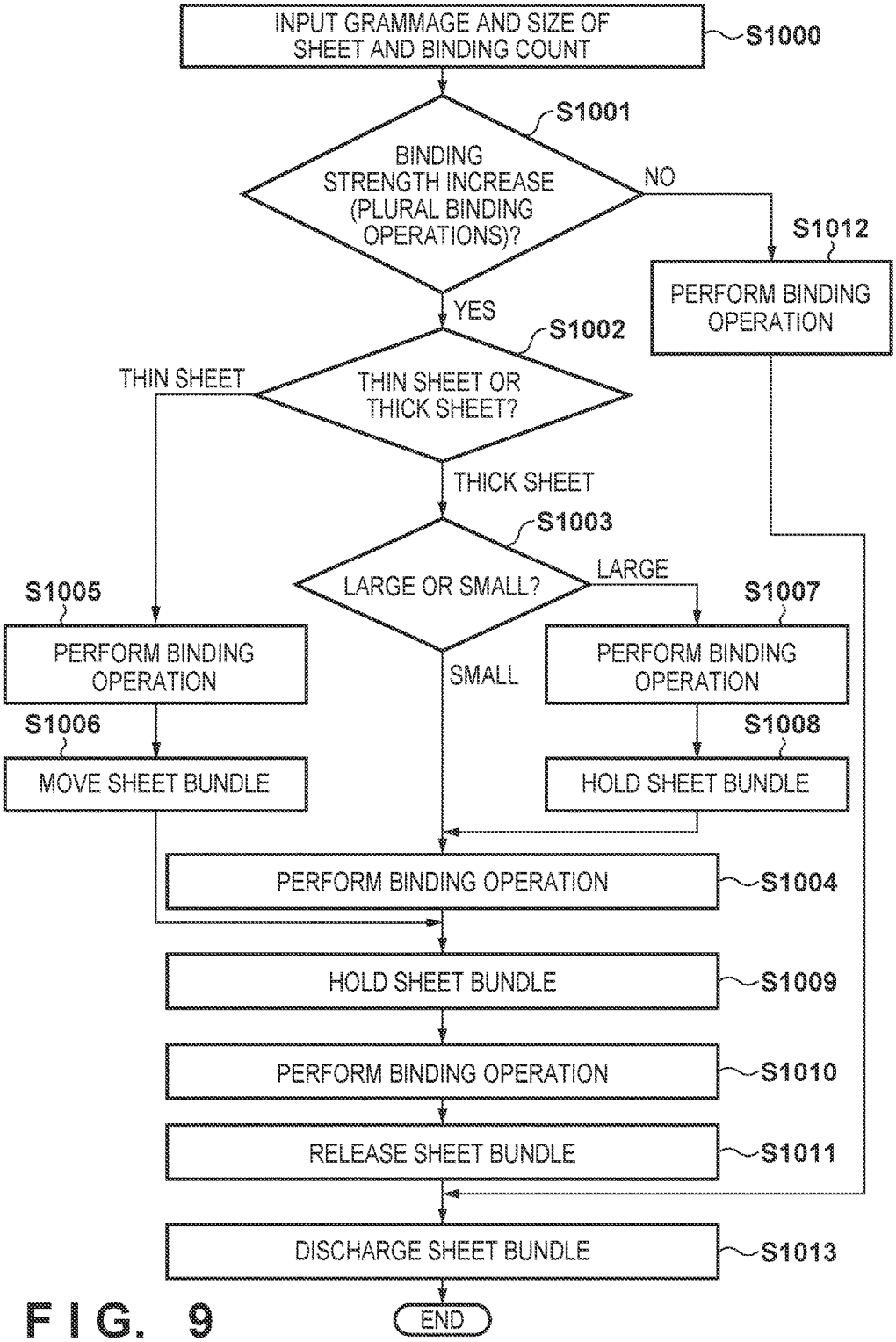
FIG. 9 is a flowchart for explaining binding processing in the binding strength increase control.

FIG. 9 is a flowchart showing an example of the control sequence of the eco-stapling operation according to this embodiment. Note that the binding operation control is implemented by causing the CPU 952 to load and execute the control programs stored in, for example, the ROM 953. A description will be made assuming that a print job including an eco-stapling operation is input.

The user reads the input job contents (sheet information) (step S1000). The job contents can be specified from, for example, the set values set by the user on the operation unit 600 and the detection signals from the various kinds of sensors. For example, the paper type, grammage, a binding count, and the like can be specified from the set values, and the sheet size can be specified by the detection signal from the sensor. This specifying method is merely an example. Sensors for detecting the sheet thickness and the paper type may be used. It is then determined whether the binding strength increase control is selected (step S1001). This determination is based on the "binding strength increase setting" value set in the user interface in FIG. 7. If the binding strength increase is designated (YES in step S1001), the process advances to the process in step S1002; otherwise (NO in step S1001), the process advances to the process in step S1012.

If control is the binding strength increase control (YES in step S1001), the sheet grammage is evaluated. If the sheet grammage is equal to or more than a predetermined value, that is, if the sheet is a thick sheet (thick sheet in step S1002), the process advances to the process of step S1003; otherwise (thin sheet in step S1002), the process advances to the process of step S1005.

The sheet size is determined in step S1003. If the sheet size is smaller than a predetermined size, that is, if the sheet is a small sheet, (small in step S1003), the process advances to the process of step S1004; otherwise (large in step S1003), the process advances to step S1007.

The process advances to steps S1004, S1005, S1007, and S1012 in accordance with the sheet information of the job. The first binding operation is then performed. If the binding strength increase control is not set, the binding operation in step S1012 is performed, and then the process advances to step S1013. If the sheet is a thick sheet having a large size, the binding operation is performed in step S1007, and then the sheets are fixed by the aligning members 641 and the paper sheet trailing end stoppers 631 (step S1008), and the process then advances to step S1004. In step S1004, the binding operation is performed, and then the process advances to step S1009. In step S1004, if the sheet is a thick sheet having a small size, the first binding processing is performed. However, if the sheet is a thick sheet having a large size, the second binding processing is performed.

If the sheet is a thin sheet, after the binding operation is performed in step S1005, and then the sheet bundle is moved by the aligning members 641 in a direction perpendicular to the discharge direction (step S1006). The process then advances to step S1009.

In step S1009, the sheet bundle is kept held by the aligning members 641 and the paper sheet trailing end stoppers 631, and then process advances to step S1010. Note that if the paper sheets are kept held in the previous operation, this state is maintained. In step S1010, after the binding operation is performed, the aligning members 641 are retracted to release the sheet bundle (step S1011), and the sheet bundle is discharged (step S1013), thereby completing a series of processing operations. As described above, the binding count is variable depending on the grammage and size of the sheet. In the example of FIG. 9, if the binding strength increase is set, the staple free stapling operation is performed twice at positions where the binding positions partially overlap if the sheet is a thin sheet. If the sheet is a thick sheet having a small size, the staple free stapling operation is performed twice at the same position. If the sheet is a thick sheet having a large size, the staple free stapling operation is performed three times at the same binding position. If the two binding positions are set, control in FIG. 9 may be performed for each of the binding positions. Alternatively, if the two binding positions are set and a plurality of binding operations are performed at each of the binding position by the control in FIG. 9, the binding count may be decreased by one at each binding position. In this case, for example, it is determined whether a job having a plurality of binding positions is set immediately before steps S1005 and S1004. If the plurality of binding positions are set, the immediately preceding binding processing is skipped.

As described above, the binding strength of the eco-stapling operation can be increased in the image forming system 10 of this embodiment.

<Evaluation Example>

The evaluation results of binding forces are shown for the identical binding positions when one eco-stapling operation is performed and a plurality of eco-stapling operations are performed while the eco-stapler 550 is not moved. The first example shows the binding force when thick sheets (120 g sheet) overlap each other and are bound. The second example shows the binding force when a thick sheet and a thin sheet (plain sheet of 68 g) overlap each other and are bound. Note that the values indicating the bonding forces in the table are values measured by a push-pull gauge in torque (mN/m) when the sheets are separated.

•Thick Sheet and Thick Sheet

| | | Binding Force |
|---|---|---|
| Binding Count | 1 | 216.1 |
| Binding Count | 2 | 335.3 |

•Thick Sheet and Thin Sheet (Plain sheet)

| | | Binding Force |
|---|---|---|
| Binding Count | 1 | 182.7 |
| Binding Count | 2 | 281.1 |

As can be apparent from the above results, when the plurality of binding operations are performed without moving the eco-stapler 550, the binding force increased about 1.5 times. It is obvious that a relatively large binding force can be applied as compared with a case in which one binding operation is performed. The embodiment described above has been made to explain the present invention in detail. The present invention is not limited to this embodiment.

Second Embodiment

The second embodiment of the present invention will now be described below. The arrangement of an image forming system is the same as that of the first embodiment as described with reference to FIGS. 1 to 6. A user interface for binding setting is the same as in FIG. 7, and the binding method is the same as in FIGS. 8A to 8C. The reference numerals as in the first embodiment described above denote the same parts.

Figure 10:
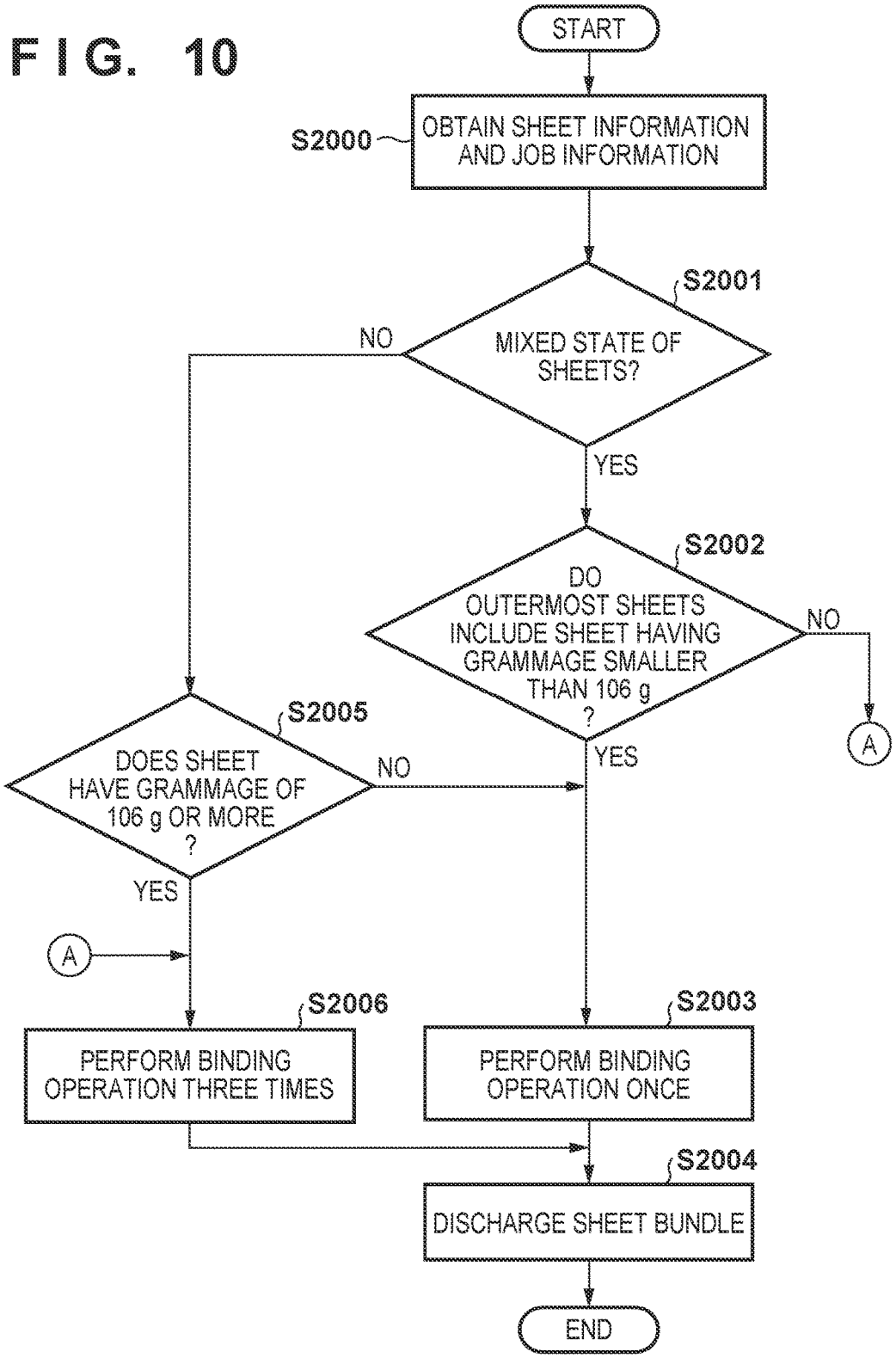
FIG. 10 is a flowchart showing an example of a control sequence of an eco-binding operation according to the second embodiment.

FIG. 10 is a flowchart showing an example of the control sequence of an eco-stapling operation according to the second embodiment. Note that binding operation control is implemented by causing a CPU 952 to load and execute control programs stored in, for example, a ROM 953. A description will be made assuming that a print job including a binding operation using an eco-stapling is input.

If a print job including a binding operation using eco-stapling, sheet information and job information are obtained in step S2000. The sheet information can be obtained from information set by a user on, for example, an operation unit 600 or detection signals of various kinds of sensors (not shown). For example, a paper type, a thickness, a binding count, the presence/absence of thick and thin sheets, the presence/absence of a cover page, a sheet size, and the like can be obtained as information. According to this embodiment, the sheet grammage is obtained as the sheet information. Job information received by an image forming apparatus 200 is obtained as the job information.

It is determined in step S2001 based on the job information obtained in step S2000 whether a sheet bundle has a mixed state of different sheets. If the mixed state is set, printing and post-processing are performed for sheets having a plurality of standards (specifications) different in the size, grammage, and paper type in one print job. If a print job having this mixed state is set, post-processing such as binding is often performed for, as a target, a sheet bundle having different sheets with different grammage values and sizes. For this reason, a specific job may be determined as a job having a mixed state of sheets if the specifications of the sheets described in the sheet information such as the sheet size, paper size, and grammage and the job information are not identical. If all the sheets are not identical, for example, an inserter may insert a cover or interleaf having grammage different from that of the sheets of the main body. In this case, if the grammage of the sheet designated as the printing target does not match the grammage of the sheet placed on the inserter, the mixed state of sheets is determined. Of course, this is merely an example. Information explicitly indicating the mixed state of sheets may be included in the job information and the mixed state may be determined with reference to this information. Alternatively, the sheet grammage may be included in the job information or may be information set for each paper feed tray of a printer. In the latter case, the grammage set for a paper feed tray designated by, for example, the job information is referred to.

If it is determined in step S2001 that the sheet bundle has a mixed state of sheets (YES in step S2001), it is determined in step S2002 based on the job information obtained in step S2000 whether the outermost sheets of the sheet bundle, that is, uppermost sheet (the position closest to an upper tooth 1010) of the sheet bundle and the lowermost sheet (the position closest to a lower tooth 1014) includes a sheet having grammage (weight per $m^2$) less than predetermined grammage, for example, 106 $g/cm^2$.

If it is determined in step S2002 that at least one of the outermost sheets of the sheet bundle includes a sheet having grammage of less than 106 $g/m^2$ (YES in step S2002), the binding operation is performed in step S2003 once for the sheet bundle conveyed and held at the binding position. In step S2004, the sheet bundle is released and discharged to a stacking tray 700.

If it is determined in step S2002 that the outermost sheets of the sheet bundle do not include a sheet having grammage of less than 106 $g/m^2$ (NO in step S2002), the stapling operation is performed in step S2006 twice for the sheet conveyed and held at the binding position. In step S2004, the sheet bundle is then released and discharged to the stacking tray 700.

If it is determined in step S2001 that the sheet bundle has no mixed state of sheets (NO in step S2001), it is then determined in step S2005 whether each sheet forming the sheet bundle has grammage of 106 $g/m^2$ or more.

If it is determined in step S2005 that each sheet forming the sheet bundle has grammage of 106 $g/m^2$ or more (YES in step S2005), the binding operation is performed in step S2008 twice for the sheet bundle conveyed and held at the binding position. In step S2004, the sheet bundle is released and discharged to the stacking tray 700.

If it is determined in step S2005 that each sheet forming the sheet bundle has grammage of less than 106 $g/m^2$ (NO in step S2005), the binding operation is performed in step S2003 once for the sheet bundle conveyed and held at the stapling position. In step S2004, the sheet bundle is released and discharged to the stacking tray 700.

By performing the control as described above, sheet tear can be prevented while improving the binding strength in accordance with the thickness of the outermost sheet, thereby increasing the binding strength.

In the second embodiment described above, the binding count is set to 1 or 2. However, the present invention is not limited to this. The binding count may be changed, as needed. In addition, a sheet having grammage not included in the job information or sheet information may be regarded as a sheet having grammage of less than 106 $g/m^2$, and processing in FIG. 10 may be performed.

Third Embodiment

The third embodiment of the present invention will now be described below. The same reference numerals as in the above embodiments denote the same parts.

Figure 11:
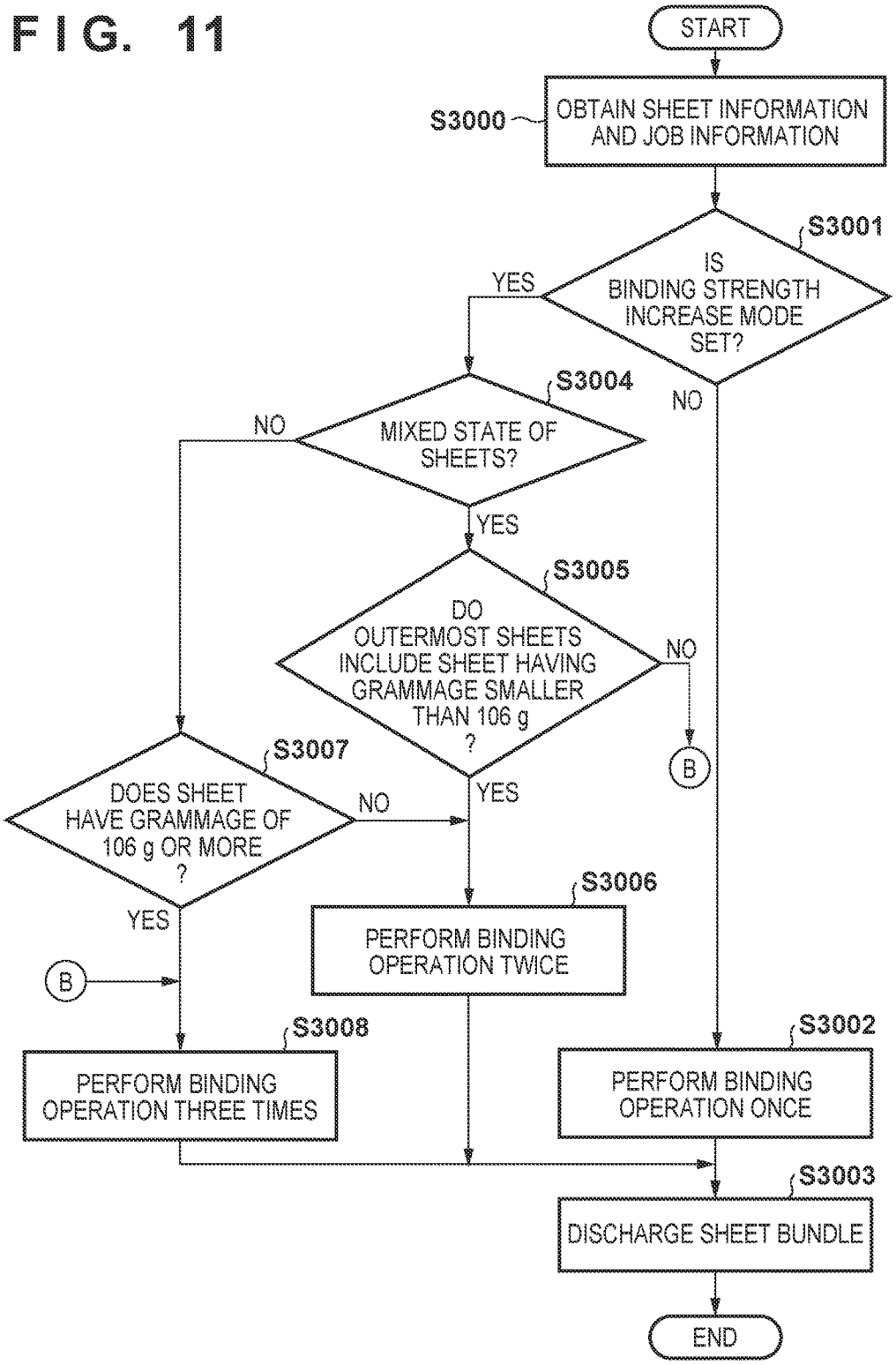
FIG. 11 is a flowchart showing an example of a control sequence of an eco-stapling operation according to the third embodiment.

FIG. 11 is a flowchart showing an example of the control sequence of an eco-stapling operation according to the third embodiment. Note that stapling operation control is implemented by causing a CPU 952 to loads and execute control programs stored in, for example, a ROM 953. A description will be made assuming that a print job including a binding operation using an eco-stapling is input.

If a print job including a binding operation using an eco-stapling, sheet information and job information are obtained in step S3000. The sheet information can be obtained from information set by a user on, for example, an operation unit 600 or detection signals of various kinds of sensors (not shown). For example, a paper type, a thickness, a stapling count, the presence/absence of thick and thin sheets, the presence/absence of a cover page, a sheet size, and the like can be obtained as information. According to this embodiment, the sheet grammage is obtained as the sheet information. Job information received by an image forming apparatus 200 is obtained as the job information.

It is determined in step S3001 whether the binding strength increase mode is selected. The binding strength will be described later as the magnitude of the binding force described above. If it is determined in step S3001 that the stapling strength increase mode is not selected (NO in step S3001), the binding operation is performed in step S3002 once for the sheet bundle conveyed and held at the binding position. In step S3003, the sheet bundle is released and discharged to a stacking tray 700. Note that the binding strength increase mode may be designated in the job information of the printing job or may be designated by the user using the operation unit 600. As a matter of course, the binding strength increase mode may be designated by another method.

If it is determined in step S3001 that the binding strength increase mode is selected (YES in step S3001), it is determined in step S3004 based on the job information obtained in step S3000 whether the sheet bundle has a mixed state of sheets. The determination of the mixed state can be performed as in the second embodiment.

If it is determined in step S3004 that the sheet bundle has a mixed state of sheets (YES in step S3004), it is determined in step S3005 based on the job information obtained in step S3000 whether the outermost sheets of the sheet bundle, that is, uppermost sheet (the position closest to an upper tooth 1010) of the sheet bundle and the lowermost sheet (the position closest to a lower tooth 1014) includes a sheet having grammage (weight per $m^2$) less than predetermined grammage, for example, 106 $g/cm^2$.

If it is determined in step S3005 that at least one of the outermost sheets of the sheet bundle includes a sheet having grammage of less than 106 $g/m^2$ (YES in step S3005), the binding operation is performed in step S3006 twice for the sheet bundle conveyed and held at the binding position. In step S3003, the sheet bundle is released and discharged to the stacking tray 700.

If it is determined in step S3005 that the outermost sheets of the sheet bundle do not include a sheet having grammage of less than 106 $g/m^2$ (NO in step S3005), the binding operation is performed in step S3008 three times for the sheet conveyed and held at the binding position. In step S3003, the sheet bundle is then released and discharged to the stacking tray 700.

If it is determined in step S3004 that the sheet bundle has no mixed state of sheets (NO in step S3004), it is then determined in step S3007 whether each sheet forming the sheet bundle has grammage of 106 $g/m^2$ or more.

If it is determined in step S3007 that each sheet forming the sheet bundle has grammage of 106 $g/m^2$ or more (YES in step S3007), the binding operation is performed in step S3008 three times for the sheet bundle conveyed and held at the binding position. In step S3003, the sheet bundle is released and discharged to the stacking tray 700.

If it is determined in step S3007 that each sheet forming the sheet bundle has grammage of less than 106 g/m$^2$ (NO in step S3007), the binding operation is performed in step S3006 twice for the sheet bundle conveyed and held at the binding position. In step S3003, the sheet bundle is released and discharged to the stacking tray 700.

By performing the control as described above, when the binding strength increase mode is selected, sheet tear can be prevented while improving the binding strength in accordance with the thickness of the outermost sheet, thereby increasing the binding strength.

In the third embodiment described above, the binding count in the binding strength increase mode is set 2 or 3. However, the present invention is not limited to this. Even if the binding strength increase mode is selected, the binding operation is performed only once without increasing the binding count if the grammage is less than, for example 106 g/m$^2$. In addition, a threshold of less than 106 g/m$^2$ is further set and the binding operation is performed once without increasing the binding count. This makes it possible to prevent sheet tear when eco-stapling is performed for a sheet which has a small grammage value, that is, a sheet which is thin and readily torn.

As described above, in this embodiment, when the binding strength increase mode is set, the binding method is controlled in accordance with the grammage as the sheet information. However, the strength increase control may be performed using another sheet information (for example, a paper type input by the user) as the reference. For example, the strength increase control may be performed for a predetermined paper type. If one of the conditions for the strength increase control is satisfied, the strength increase control may be performed. Alternatively, if a plurality of specific conditions are satisfied out of these strength increase control conditions, the strength increase control may be performed.

According to each embodiment described above, the binding processing with a higher binding force of the sheet bundle can be implemented with a simple arrangement by controlling the staple free stapling position or its count in accordance with the sheet information. In addition, when the grammage of the sheet is considered as the sheet information, damage to the sheet by staple free stapling can be suppressed.

As a staple free stapling unit of each embodiment described above, a binding mechanism by forming the concave and convex portions in the sheet bundle is exemplified. However, the present invention can be applied to another mechanism.

The present invention can be practiced by combining the embodiments described above. For example, in the second and third embodiments described above, the binding processing is performed at the same position. However, as described with reference to the first embodiment, the binding processing may be performed so that the binding positions are shifted to at least partially overlap the binding positions. Moreover, the binding processing may be performed multiple times at different positions which are not overlapped one another.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-Ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-081423, filed Apr. 17, 2017, and No. 2018-045827, filed Mar. 13, 2018 which are hereby incorporated by reference herein in their entirety.

What is claimed is:

1. A sheet processing apparatus comprising:

a binding unit configured to perform binding processing for a sheet bundle without using a staple;

an obtaining unit configured to obtain information about grammage values of sheets forming the sheet bundle; and a control unit configured to control the binding unit to allow a change in a count of the binding processing by the binding unit in accordance with information about the grammage values of outermost sheets of the sheet bundle, the information being obtained by the obtaining unit, if the obtaining unit obtains information indicating that the sheet bundle is made of sheets having a plurality of different grammage values.

2. The apparatus according to claim 1, wherein the control unit controls the binding unit to allow a change between binding processing performed once by the binding unit and binding processing performed at an overlapping position a plurality of times by the binding unit in accordance with information about the grammage values of the outermost sheets of the sheet bundle, the information being obtained by the obtaining unit, if the obtaining unit obtains the information indicating that the sheet bundle is made of sheets having the plurality of different grammage values.

3. The apparatus according to claim 1, wherein the control unit controls the binding unit to allow a change in the count of binding processing at an overlapping position in accordance with information about the grammage values of the outermost sheets of the sheet bundle, the information being obtained by the obtaining unit, if the obtaining unit obtains the information indicating that the sheet bundle is made of sheets having the plurality of different grammage values.

4. The apparatus according to claim 1, wherein the binding unit includes:

an upper tooth having a first concave portion and a first convex portion and configured to press a sheet by the first convex portion from above; and a lower tooth having a second concave portion and a second convex portion and configured to press a sheet by the second convex portion from below, the second concave portion and the second convex portion being formed such that the second convex portion is inserted into the first concave portion and the first convex portion is inserted into the second concave portion when the lower tooth meshes with the upper tooth.

5. The apparatus according to claim 4, wherein the outermost sheets of the sheet bundle include a sheet closest to the upper tooth and a sheet closest to the lower tooth out of the sheets forming the sheet bundle.

6. The apparatus according to claim 1, wherein the control unit changes the count of binding processing when the obtaining unit obtains information indicating that the grammage values of the outermost sheets of the sheet bundle are not less than a predetermined grammage value from a first count of binding processing to a second count of binding processing which is larger than the first count and obtained when the obtaining unit obtains information indicating that the outermost sheets of the sheet bundle include a sheet having a grammage value less than a predetermined grammage value.

7. The apparatus according to claim 1, further comprising a selection unit configured to select one of a first binding strength and a second binding strength higher than the first binding strength to perform binding processing of the stapling unit, wherein if binding processing with the second binding strength is selected, the control unit changes the count of the binding processing to a count larger than one in accordance with the obtained grammage values of the outermost sheets of the sheet bundle.

8. The apparatus according to claim 7, wherein if binding processing with the first binding strength is selected, the control unit allows binding processing of the sheet bundle using the count of the binding processing as one.

9. The apparatus according to claim 7, further comprising a stapling unit configured to perform stapling processing for a sheet using the staple, wherein the selection unit can select one of the binding unit and the stapling unit to perform binding processing.

10. The apparatus according to claim 9, wherein when the selection unit selects the stapling unit, the control unit allows stapling processing of the sheet using a stapling count of the stapling unit as one.

* * * * *